United States Patent [19]

Branson

[11] Patent Number: 4,758,099

[45] Date of Patent: Jul. 19, 1988

[54] FLEXIBLE CONTAINER HAVING RESEALABLE CLOSURE

[75] Inventor: Mark Branson, Shelbyville, Ind.

[73] Assignee: KCL Corporation, Shelbyville, Ind.

[21] Appl. No.: 8,568

[22] Filed: Jan. 29, 1987

[51] Int. Cl.[4] ..... B65D 30/24

[52] U.S. Cl. ..... 383/44; 383/35; 383/57

[58] Field of Search ..... 383/44, 43, 47, 93, 383/95, 35, 61

[56] References Cited

U.S. PATENT DOCUMENTS

| | | | |
|---|---|---|---|
| 2,695,646 | 11/1954 | Van Wyk | 383/35 |
| 2,799,314 | 7/1957 | Dreyer et al. | 383/44 |
| 3,106,159 | 10/1963 | Abramson | 383/57 |
| 3,189,252 | 6/1965 | Miller | 383/57 |
| 3,473,532 | 10/1969 | Eisenberg | 383/44 |
| 3,746,215 | 7/1973 | Ausnit et al. | 383/61 |
| 4,204,526 | 5/1980 | Samuels et al. | 383/35 |

*Primary Examiner*—Willis Little

*Attorney, Agent, or Firm*—Robert S. Beiser

[57] ABSTRACT

A resealable container having flexible side walls defining an access opening, and a sealing cuff disposed internally of said access opening. The sealing cuff is formed from a film sheet having a first marginal edge affixed to the container about the periphery of the access opening and having a free second marginal edge extending into the container. The sealing cuff defines mutually oposed surfaces having high cling characteristics so as to form a seal therebetween when brought into surface engagement. An external cuff having high slip properties may be formed peripherally of the access opening to facilitate opening of the internal sealing cuff.

23 Claims, 2 Drawing Sheets

FIG. 1
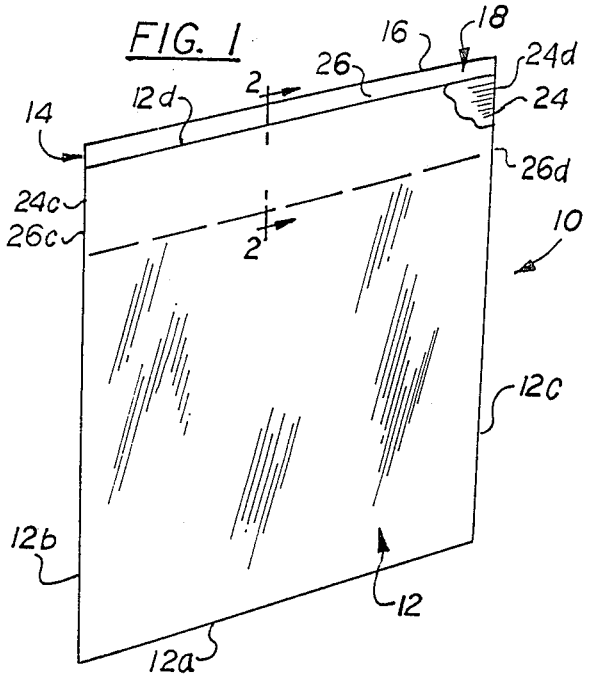
FIG. 2
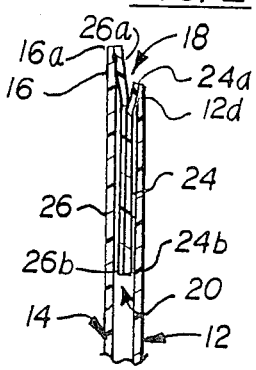
FIG. 3
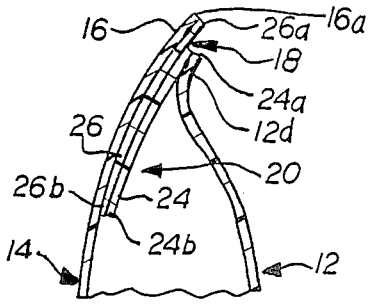
FIG. 8
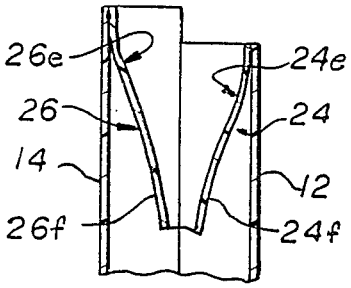
FIG. 5
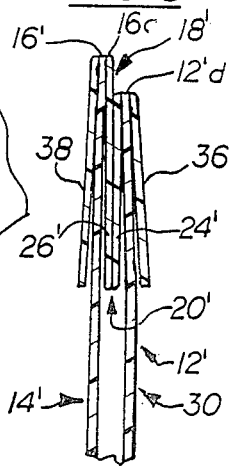
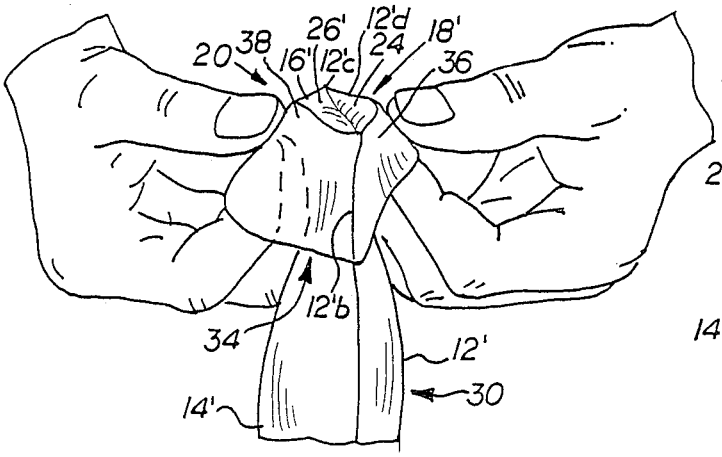
FIG. 4

FLEXIBLE CONTAINER HAVING RESEALABLE CLOSURE

BACKGROUND OF THE INVENTION

The present invention relates generally to flexible resealable containers, and more particularly to such containers having a novel sealing cuff formed internally of the container access opening and having mutually cooperable surfaces with high cling properties which facilitate resealable opening and closing of the container.

Flexible containers having releasable sealing means in the form of releasable adhesive strips, zippers, and interlocking profiles and the like adjacent their access openings to facilitate resealable closing of the containers are generally known. Examples of prior flexible containers which employ closure strips of releasable adhesive material adjacent the container opening to facilitate closing of the container are disclosed in the following U.S. Patents:

U.S. Pat. No. 2,215,989 to Madsen
U.S. Pat. No. 2,682,902 to Metzger
U.S. Pat. No. 3,070,280 to Madsen
U.S. Pat. No. 3,154,239 to Madsen
U.S. Pat. No. 3,279,331 to Platt
U.S. Pat. No. 2,825,497 to Hitt
U.S. Pat. No. 3,198,228 to Naito
U.S. Pat. No. 3,307,773 to Cratzer et al.
U.S. Pat. No. 3,310,225 to Hoblit
U.S. Pat. No. 3,340,116 to Naito
U.S. Pat. No. 3,633,642 to Siegel
U.S. Pat. No. 3,826,296 to Morris
U.S. Pat. No. 3,990,627 to Olson A resealable flexible container having naturally adherent peripheral marginal surfaces to facilitate releasable closing of the container is disclosed in U.S. Pat. No. 3,325,083 to Frye.

While the resealable containers disclosed in the aforementioned patents which employ pressure sensitive adhesives have proven generally satisfactory, they exhibit a significant drawback in that the pressure sensitive adhesives have limited periods of usefulness. Further, they are subject to relatively high manufacturing costs.

SUMMARY OF THE INVENTION

One of the primary objects of the present invention is to provide a flexible container having novel closure means in the form of an internal sealing cuff which facilitates resealable closing of the container and which enables significant manufacturing economies to be realized.

A more particular object of the present invention is to provide a flexible container having a novel sealing cuff formed internally of the access opening, the sealing cuff including a pair of flexible film-like sheets affixed along their marginal edges to the container peripherally of the access opening so as to extend into the container and having mutually opposed surfaces of high cling properties which facilitate resealable adherence to each other to close the container.

Another object of the invention is to provide a flexible container as aforementioned wherein the surfaces of the internal sealing cuff opposed to the walls of the container have high slip properties so as not to adhere to the container wall.

A feature of one embodiment of the flexible container in accordance with the invention lies in the provision of an external high slip cuff peripherally of the access opening to facilitate opening of the container when in a closed sealed condition.

In accordance with the invention, a flexible container is formed with a sealing cuff, the cuff being positioned internally from and peripheral to the access opening of the container. The sealing cuff is made of a polyolefin film affixed, as by heat sealing, along one edge to a marginal edge of the container peripheral to the access opening so that the cuff extends into the container and defines mutually opposed surfaces. The sealing cuff is formed such that the opposed surfaces have high cling properties or characteristics, and the opposite cuff surfaces opposing the flexible container walls have high slip properties or characteristics. In this manner the high cling surfaces of the cuff may be readily brought into sealing engagement to close the container, while the high slip surfaces do not cling to the container walls. This helps prevent the contents of the container from forcing open the sealing cuff, as will be explained herein.

In one embodiment, the sealing cuff is formed from a single layer of low density polyolefin film which is treated to form the opposite high cling and high slip surfaces on each surface of the sealing cuff. Alternatively, the sealing cuff may be formed by coextruding two different polyolefin materials to establish a low density, high cling surface and an opposite high density, high slip surface on the sealing cuff. As a further alternative embodiment, the sealing cuff may be formed from adhered film strips, one strip having high densit, high slip properties and the other having low density, high cling propeties so as to form the desired surface characteristics. An external non-sealing cuff having high slip characteristics may be formed about the periphery of the container access opening facilitate release of the internal sealing cuff and opening of the container.

Further objects and advantages of the invention will become apparent from the following detailed description of the invention taken in conjunction with the accompanying drawing in which like reference numerals designate like elements throughout the several views.

BRIEF DESCRIPTION OF THE DRAWING

FIG. 1 is a front perspective view of a flexible reclosable container employing a resealable closure made in accordance with one embodiment of the present invention;

FIG. 2 is an enlarged vertical sectional view partially broken away taken substantially along line 2—2 of the flexible reclosable container FIG. 1;

FIG. 3 is a vertical sectional view partially broken away similar to FIG. 2 but illustrating the position of the internal sealing cuff urged against a wall of the container when subjected to internal pressure;

FIG. 4 is a perspective view partially broken away of a flexible container similar to the container of FIG. 1 but having an external cuff to facilitate opening;

FIG. 5 is a vertical sectional view partially broken away, on an enlarged scale, of the closure end of the container illustrated in FIG. 4;

FIG. 8 is an enlarged vertical sectional view, partially broken away, taken along line 2—2 of the flexible reclosable container of FIG. 1 showing in particular the internal sealing cuff separated into individual sheets for access to the container.

DESCRIPTION OF PREFERRED EMBODIMENTS

Figure 7:
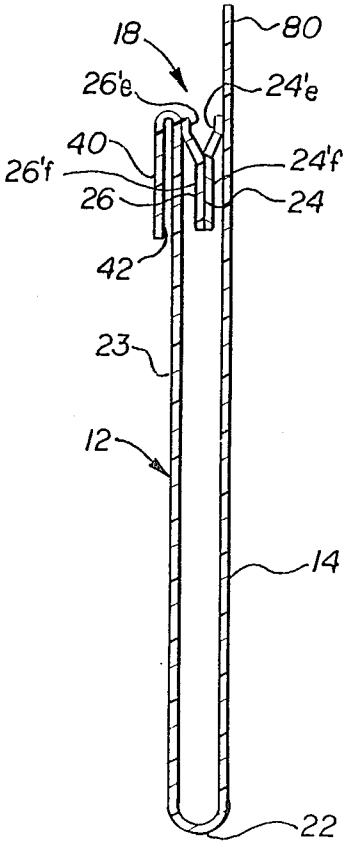
FIG. 7 is a vertical sectional view partially broken away taken along line 7—7 of the flexible reclosable container of FIG. 6.

Referring now to the drawing, and in particular to FIGS. 1-3, a reclosable flexible container constructed in accordance with one embodiment of the present invention is indicated generally at 10. The flexible container 10, which is of the resealable type and may alternatively be termed a bag or pouch, is illustrated as having a generally rectangular configuration and preferably includes a transparent flexible front and back walls or panels 12 and 14. The front and back walls 12 and 14 are made of a material which enables the bottom and side marginal edges of the walls to be heat sealed togther, such as along the bottom edge 12*a* and the longitudinal side edges 12*b* and 12*c*. Suitable materials from which the container walls may be formed include the polyolefins such as polyethylene, polypropylene, ethylenepropylene copolymers and similar heat-sealable, film-forming plastic materials.

In the illustrated embodiment, the rear or back wall 14 is made of a height, as shown in FIG. 1, slightly greater than the height of the front wall 12 so as to define a marginal area 16 extending above and parallel to an upper free edge 12*d* of the front wall 12. The upper marginal area 16 of the back panel 14 cooperates with the opposed upper marginal edge 12*d* of the front wall 12 to define an access opening 18 into the container 10 when the upper marginal edges 16*a* and 12*d* are separated. The embodiment of FIG. 1 illustrates the front and back walls 12 and 14 as being discrete walls or panels heat sealed along their bottom and side edges to form the container. It will be appreciated that the container 10 may be made from a tubular length of flexible heat sealable material cut to desired length and heat sealed generally transversely to create a closed bottom end, the opposite end of the cut-to-length tube defining the access opening to the container.

As shown in FIG. 2 in accordance with the present invention, means for sealing the container 10 are provided in the form of a resealable sealing cuff, indicated generally at 20. The cuff 20 is formed internally of the access opening 18 to facilitate releasable sealed closing of the container. The resealable sealing cuff 20 comprises an internal flexible band which extends about the full internal periphery of the access opening 18. In the illustrated embodiment, the sealing cuff is formed from a pair of generally rectangular film sheets or strips 24 and 26 which have their upper marginal edges 24*a* and 26*a* respectively affixed, as by heat sealing, to the respective marginal edges 12*d* and 16*a* of the front and back container walls 12 and 14. As shown in FIG. 1 the opposite marginal end edges 24*c* and 24*d* of the film sheet 24 are heat sealed to and between the longtiudinal marginal side edges 12*b* and 12*c* respectively of the front and back container walls 12 and 14. Similarly, the opposite marginal edges 26*c* and 26*d* of the film sheet 26 are heat sealed to and between the longitudinal side marginal edges 12*b* and 12*c* respectively of the front and back container walls 12 and 14 respectively. As a result, each of the sealing cuff sheets is heat sealed along its side edges and its top edge to its associated contaienr wall, with a free lower edge extending into the container as indicated at 24*b* and 26*b*, respectively.

As shown in FIG. 8, in accordance with an important feature of the container 10, the sealing cuff film sheets 24 and 26 have mutually opposed resealable surfaces 24*e* and 26*e* having high cling properties or characteristics. The opposite surfaces 24*f* and 26*f*, respectively, which oppose the respective front and back container walls 12 and 14 are characterized as having high slip properties. The terms high slip and high cling refer to the coefficient of friction of the material; high slip has a low coefficient of friction, high cling has a high coefficient of friction. The high cling surfaces 24*e* and 26*e* of the sealing cuff sheets 24 and 26 may be brought into surface-to-surface engagement by running one's fingers along the outer surfaces of the front and rear walls 12 and 14 of the container 10 proximate access opening 26. The sealing cuff sheets 24 and 26 are interposed therebetween. This surface to surface contact effects sealing engagement between the sealing cuff sheets 24 and 26, thereby sealing the container 10. Because the opposite sealing cuff surfaces 24*f* and 26*f* have high slip, they do not cling to the corresponding front and rear walls 12 and 14 of the container. Thus, when the container is closed by sealing engagement of the high cling surfaces 24*e* and 26*e*, objects contained within container 10, when directed toward opening 18, tend to cause sealed cuff sheets 24 and 26 to move toward front wall 12 or rear wall 14, but remain sealed together. This is a particular improvement of the present invention over prior art pressure sensitive adhesive closures. Similarly, any air captured within the upper region of the container will urge the sealed cuff sheets 24 and 26 against the back container wall 14, as illustrated in FIG. 3, or against the front container wall 12.

The sealing cuff film sheets 24 and 26 may be made from a low density polyolefin film such as MOBIL low density polyethylene which is treated in a known manner to form one side surface having high cling properties and the opposite side surface having high slip properties. For example the low density polyolefin film may be treated with a high cling additive such as ethylene-vinyl acetate on one side 24*e*. The opposite side 24*f* may already have sufficient high slip properties, or if necessary may be treated with a high slip. The treated polyolefin film sheets are then affixed between the front and back container walls 12 and 14 such that the mutually opposed sealing cuff surfaces 24*e* and 26*e* have high cling properties which facilitate resealable closing of the container.

In an alternative embodiment, the sealing cuff film sheets 24 and 26 may be formed from two differnet materials which are co-extruded such that each material forms a discrete one of the opposite film sheet surfaces. For example, one material such as high density polyethylene may have high slip characteristics while the other material such as low density polyethylene may have an additive such as EVA to provide high cling characteristics. As a further alternative, each of the sealing cuff film sheets 24 and 26 may be formed from two separate film sheets affixed together in juxtaposed relation to form a single sheet, one of the film sheets having high cling characteristics and the other having high slip characteristics so as to form the corresponding surfaces 24*e* and 24*f* and 26*e* and 26*f* of the sealing cuff sheets 24 and 26.

While the sealing cuff 20 has been described as being formed by two discrete film sheets 24 and 26, the sealing cuff 20 could be formed as an integral continuous band having its marginal edges affixed to the marginal edges 12*d* and 16 of the container walls. The outer surface of the band may be treated for high cling, or high slip as required.

FIGS. 4 and 5 illustrate an alternative embodiment of a resealable flexible container, indicated generally at 30, in accordance with the present invention. The elements or components of container 30 which are substantially identical to the embodiment of FIGS. 1–3 are indicated by corresponding but primed reference numerals. Thus, the resealable container 30 includes front and back flexible transparent walls 12' and 14' which are heat sealed together along their juxtaposed lower marginal edges 12*a'* (not shown) and along their longitudinal side edges 12*b'* and 12*c'* to form a container or pouch having an upper access opening 18'. The container 30 has resealable sealing means in the form of a sealing cuff 20; formed internally of the upper access opening 18', the sealing cuff 20' being formed of film sheets 24' and 26' which are identical to the aforedescribed film sheets 24 and 26 forming the sealing cuff 20.

The container 30 has an external cuff, indicated generally at 34, formed externally and peripherally of the access opening 18' to facilitate opening of the container from a closed sealed condition. In the illustrated embodiment, the external cuff 34 is formed by a pair of generally rectangular film sheets 36 and 38 having their opposite marginal end edges heat sealed to the lateral side edges 12'*b* and 12'*c* of the container 30 and having their upper marginal edges affixed, respectively, to the upper marginal edges 12'*d* and 16' of the container walls, as by heat sealing. In this manner, the lower marginal edges of the external cuff sheets 36 and 38 are free and enable insertion of one's fingers into the pockets formed by the external cuff to facilitate release of the sealing cuff film sheets 24' and 26', as illustrated in FIG. 4. The external cuff sheets 36 and 38 may be made of a low density polyolefin film treated such that the external surfaces have high slip characteristics. Alternatively, the cuff sheets 36 and 38 may be formed from a high density, high slip material. In either case, the high slip properties of the external cuff sheets 36 and 38 prevent adherence of the external cuff sheets to the front and back container walls or panels 12' and 14'.

Figure 6:
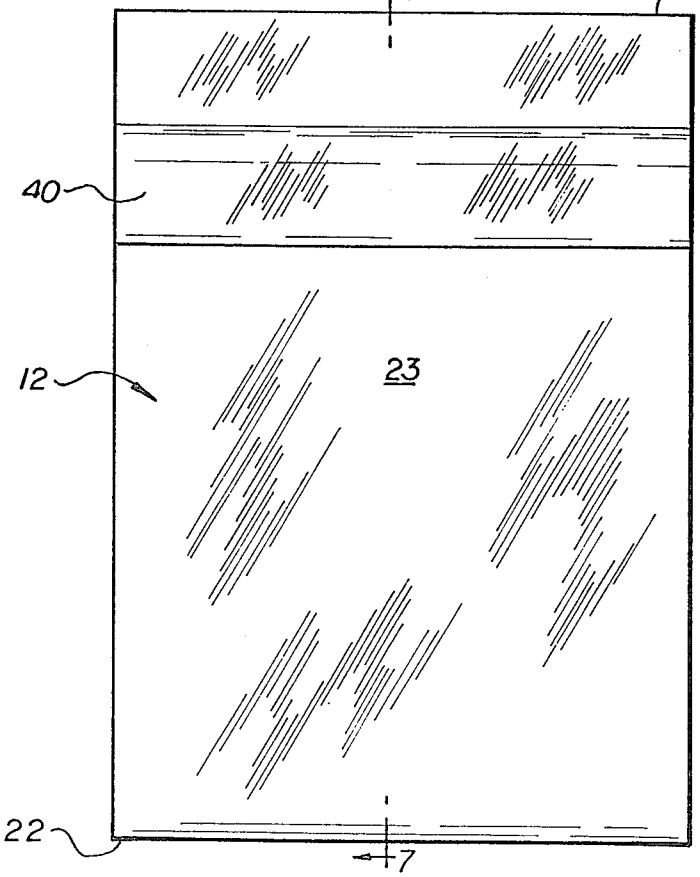
FIG. 6 is a front view of an alternative embodiment of the flexible reclosable container of FIG. 1.

As shown in FIG. 6 and 7, in an alternate embodiment of the invention, container 10 has a cuff 40 extending from front wall 12. In the embodiment shown cuff 40 comprises a rolled lip from front wall 12. Rear wall 14 has a vertical flange 80 extending above cuff 40. Sealing cuffs 24 and 26 are sealed respectively to rear wall 14 and front wall 12 and extend downwardly into pouch 10 from proximate the access opening 18. Again, high cling surface 24'*e* abutted against and adheres to high cling surface 26'*e*. High slip surface 26'*f* is abutted against front wall 12 and high slip surface 24'*f* is abutted against rear wall 14. In order to open container 10, vertical flange 80 is grasped by the user in one hand and cuff 40 is grasped in the other hand. Cuff 40 and vertical flange 80 are then pulled apart laterally so as to separate cling sheets 24 and 26.

While preferred embodiments of the invention have been illustrated and described, it will be understood to those skilled in the art that changes and modifications may be made therein without departing from the invention in its broader aspects. Various features of the invention are defined in the following claims.

What is claimed is:

1. In a flexible resealable container having an access opening, a sealing cuff comprising a pair of flexible film sheets disposed internally of said access opening, said film sheets each having first marginal edges affixed to said container about the periphery of said access opening and having second marginal edges unattached to said container and extending into said container, said film sheets defining mutually opposed surfaces having high cling characteristics such that surface engagement between said mutually opposed surfaces forms a seal therebetween to close said access opening.

2. A flexible resealable container as defined in claim 1 wherein said first marginal edges of said film sheets define a continuous edge affixed to said container about the entire periphery of said access opening.

3. A resealable container as defined in claim 1 wherein said container includes side walls having top, side and bottom edges, and wherein said access opening is defined between said top edges of said container sidewalls, said sealing cuff film sheets each having a surface thereon opposed to said container wall surfaces, said surface having high slip characteristics so as to minimize adherence of said sealing cuff film sheets to said container sidewalls.

4. A resealable container as defined in claim 1 including an external cuff formed substantially peripherally of said access opening and generally juxtaposed to the external surface of said container, said external cuff defining substantially vertical finger insertion pockets circumscribing said container to facilitate manual separation of said high cling surfaces of said sealing cuff when in sealed relation.

5. A resealable container as defined in clailm 4 wherein said external cuff is formed from a polyolefin film having high slip characteristics.

6. The flexible resealable container of claim 1 wherein each of said flexible film sheets comprise a single sheet folded in half along one marginal edge thereof.

7. In a flexible resealable container having an access opening, a sealing cuff comprising a pair of flexible film sheets disposed internally of said access opening, said film sheets each having first marginal edges affixed to said container about the periphery of said access opening and having second marginal edges unattached to said container and extending into said container, said film sheets defining mutually opposed surfaces having high cling characteristics such that surface engagement between said mutually opposed surfaces forms a seal therebetween to close said access opening:

said sealing cuff being formed from a low density polyolefin film treated so as to have high cling characteristics on said opposed surfaces.

8. A resealable container as defined in claim 7 wherein said polyolefin film is further treated such that the surface of said film sheet opposite said surface having high cling characteristics is characterized as having high slip characteristics.

9. In a flexible resealable container having an access opening, a sealing cuff comprising a pair of flexible film sheets disposed internally of said access opening, said film sheets each having first marginal edges affixed to said container about the periphery of said access opening and having second marginal edges unattached to said container and extending into said container, said film sheets defining mutually opposed surfaces having high cling characteristics such that surface engagement between said mutually opposed surfaces forms a seal therebetween to close said access opening;

said sealing cuff being formed by coextrusion of two different polyolefin materials one of which defines said surface having high cling characteristics and the other which forms an opposite surface of said film sheet having high slip characteristics.

10. In a flexible resealable container having an access opening, a sealing cuff comprising a pair of flexible film sheets disposed internally of said access opening, said film sheets each having first marginal edges affixed to said container about the periphery of said access opening and having second marginal edges unattached to said container and extending into said container, said film sheets defining mutually opposed surfaces having high cling characteristics such that surface engagement between said mutually opposed surfaces forms a seal therebetween to close said access opening;

said sealing cuff being made from discreet film strips affixed together along mutually opposed surfaces to establish said flexible film sheet, one of such strips having high cling characteristics and defining said mutually opposed surfaces of said sealing cuff, the other of said film strips having high slip characteristics.

11. The flexible resealable container of claim 10 wherein said other of said film strips having high slip characteristics comprises high density polyethylene.

12. The flexible resealable container of claim 10 wherein said strip having high cling characteristics comprises linear low density polyethylene.

13. A flexible resealable container having a generally rectangular configuration defined by flexible sidewalls having substantially free marginal edges defining an access opening, and a sealing cuff disposed internally of said access opening, said sealing cuff comprising a pair of flexible film sheets each having a first marginal edge affixed to said container about the periphery of said access opening and having a second marginal edge extending into said container, said film sheets defining mutually opposed sealing surfaces operative by means of the cling characteristics of said sealing surfaces to effect a selectively sealed relation therebetween when brought into surface engagement, said sealing cuff being configured such that after sealing together of said film sheets force exerted against said film sheets by products within said container tend to direct said film strips against one of said sidewalls of said container so as to retain said container in a sealed configuration.

14. A flexible resealable container having a generally rectangular configuration defined by flexible sidewalls having substantially free marginal edges defining an access opening, and a sealing cuff disposed internally of said access opening, said sealing cuff comprising a pair of flexible film sheets each having a first marginal edge affixed to said container about the periphery of said access opening and having a second marginal edge extending into said container, said film sheets defining mutually opposed sealing surfaces operative by means of the cling characteristics of said sealing surfaces to effect a selectively sealed relation therebetween when brought into surface engagement, said sealing cuff being configured such that after sealing together of said film sheets force exerted against said film sheets by products within said container tend to direct said film strips against one of said sidewalls of said container so as to retain said container in a sealed configuration:

said sidewalls of said container and said sealing cuff being formed from polyolefin film sheet material, said opposed surfaces of said sealing cuff having high cling characteristics.

15. A resealable container as defined in claim 14 wherein said polyolefin sheet material defines surfaces on said sealing cuff opposite to said container walls having high slip characteristics.

16. A flexible resealable container comprising a pair of container walls affixed along mutually cooperable marginal edges to establish a container pouch having an access opening into said pouch, and a sealing cuff disposed internally of said access opening, said sealing cuff comprising a pair of substantially rectangular polyolefin film sheets in substantially parallel alignment having first marginal edges affixed to said opposite sidewalls of said container, said film sheets having free second marginal edges positioned in said container, said film sheets defining mutually opposed surfaces having high cling characteristics operative to establish a selectively sealed relation therebetween when brought into surface engagement thereby sealing said container.

17. A resealable container as defined in claim 16 wherein each of said polyolefin film sheets has a surface thereon opposed to an inside wall surface of said container, said film sheet surface having high slip characteristics so as to prevent adherence to said container wall surface.

18. A resealable container as defined in claim 17 including an external cuff peripheral of said access opening and defining finger pockets to facilitate separation of said sealing cuff film sheets when in sealed relation.

19. A resealable container as defined in claim 18 wherein said external cuff extends partially along the external surface of said container circumferentially of said access opening, said external cuff being formed of a polyolefin film material having high slip characteristics.

20. The resealable container of claim 16 including a vertical flange extending from one of said sidewalls of said container and an external cuff extending from the other sidewall of said container said vertical flange and said external cuff being adapted for digital manipulation so as to facilitate opening of said container.

21. In a flexible resealable container having an access opening, a sealing cuff comprising a pair of flexible film sheets disposed internally of said access opening, said film sheets each having first marginal edges affixed to said container about the periphery of said access opening and having second marginal edges unattached to said container and extending into said container, said film sheets defining mutually opposed surfaces having high cling characteristics such that surface engagement between said mutually opposed surfaces forms a seal therebetween to close said access opening, and wherein said surface having high slip characteristics comprises low density polyethylene having lubricants incorporated therein.

22. In a flexible resealable container having an access opening, a sealing cuff comprising a pair of flexible film sheets disposed internally of said access opening, said film sheets each having first marginal edges affixed to said container about the periphery of said access opening and having second marginal edges unattached to said container and extending into said container, said film sheets defining mutually opposed surfaces having high cling characteristics such that surface engagement between said mutually opposed surfaces forms a seal therebetween to close said access opening;

said sealing cuff being formed by lamination of two different polyolefin materials one of which defines said surface having high cling characteristics, and the other of which forms an opposite surface of said film sheet having high slip characteristics.

23. A flexible resealable container having a generally rectangular configuration defined by flexible sidewalls having substantially free marginal edges defining an access opening, and a sealing cuff disposed internally of said access opening, said sealing cuff comprising a pair of flexible film sheets each having a first marginal edge affixed to said container about the periphery of said access opening and having a second marginal edge extending into said container, said film sheets defining mutually opposed sealing surfaces operative by means of the cling characteristics of said sealing surfaces to each other to effect a selectively sealed relation therebetween when brought into surface engagement, said sealing cuff being configured such that air pressure within said container in the region of said sealing cuff effects an increased sealing pressure between said mutually opposed sealing surfaces when in sealed relation.

* * * * *